US007901748B2

(12) United States Patent
Wang et al.

(10) Patent No.: US 7,901,748 B2
(45) Date of Patent: Mar. 8, 2011

(54) INK JET RECORDING ELEMENT

(75) Inventors: Yongcai Wang, Webster, NY (US); Kurt M. Schroeder, Spencerport, NY (US); Lori J. Shaw-Klein, Rochester, NY (US); Thomas P. Nicholas, Rochester, NY (US); Sridhar Sadasivan, Rochester, NY (US); Christine M. Vargas, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 988 days.

(21) Appl. No.: 10/021,341

(22) Filed: Dec. 12, 2001

(65) Prior Publication Data

US 2003/0138603 A1 Jul. 24, 2003

(51) Int. Cl.
*B41M 5/50* (2006.01)

(52) U.S. Cl. ..... 428/32.25; 428/32.34

(58) Field of Classification Search ..... 428/32.15, 428/32.25, 32.34, 32.38, 195
See application file for complete search history.

(56) References Cited

U.S. PATENT DOCUMENTS

| | | | | |
|---|---|---|---|---|
| 6,056,812 | A | 5/2000 | Lin et al. | |
| 6,217,166 | B1 * | 4/2001 | Saito et al. | 347/100 |
| 6,440,537 | B1 * | 8/2002 | Chu et al. | 428/195 |
| 7,056,969 | B2 * | 6/2006 | Cuch et al. | 524/425 |
| 2002/0071019 | A1 * | 6/2002 | Becker | 347/106 |

FOREIGN PATENT DOCUMENTS

| | | | |
|---|---|---|---|
| EP | 0 903 246 | A2 | 3/1999 |
| EP | 0 984 047 | A1 | 3/2000 |
| EP | 1 034 940 | A1 | 9/2000 |
| EP | 1 138 509 | A2 | 10/2001 |
| EP | 1 180 436 | A1 | 2/2002 |

OTHER PUBLICATIONS

BIC, "Articlle for Chemistry in Australia", Oct. 8, 2001.*

* cited by examiner

*Primary Examiner* — Bruce H Hess
(74) *Attorney, Agent, or Firm* — Harold E. Cole; Chris P. Konkol; Andrew J. Anderson

(57) ABSTRACT

An ink jet recording element with a support having thereon an image-receiving layer of inorganic particles and stabilizer particles, the stabilizer particles being free of any organic solvent and containing greater than about 80% by weight of a water-insoluble antioxidant and having a mean particle size of greater than 5 nm, the inorganic particles being greater than about 50% by weight of the ink receiving layer.

7 Claims, No Drawings

INK JET RECORDING ELEMENT

CROSS REFERENCE TO RELATED APPLICATION

Reference is made to commonly assigned, co-pending U.S. patent application Ser. No. 10/017,937 by Wang et al., filed of even date herewith entitled "Ink Jet Printing Method".

FIELD OF THE INVENTION

The present invention relates to an ink jet recording element containing a mixture of various particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

There are generally two types of ink-receiving layers (IRL's). The first type of IRL comprises a non-porous coating of a polymer with a high capacity for swelling and absorbing ink by molecular diffusion. Cationic or anionic substances are added to the coating to serve as a dye fixing agent or mordant for the cationic or anionic dye. This coating is optically transparent and very smooth, leading to a high glossy "photograde" receiver. The second type of IRL comprises a porous coating of inorganic, polymeric, or organic-inorganic composite particles, a polymeric binder, and additives such as dye-fixing agents or mordants. These particles can vary in chemical composition, size, shape, and intra-particle porosity. In this case, the printing liquid is absorbed into the open pores of the IRL to obtain a print which is instantaneously dry to the touch.

A glossy, porous IRL usually contains a base layer and a glossy image-receiving layer. When coated on plain paper, the base layer is laid down underneath the glossy image-receiving layer. In order to provide a smooth, glossy surface on the image-receiving layer, special coating processes are often utilized, such as cast coating and film transfer coating. Calendering with heat and pressure is also used in combination with conventional blade, rod or air-knife coating on plain paper to produce gloss on the image-receiving layer.

While glossy, porous IRL's have the ability to absorb high concentrations of ink instantly, they suffer from image fastness problems, such as fading due to exposure to radiation by daylight, tungsten light, fluorescent light, or ozone, as described by D. E. Bugner and C. Suminski, "Filtration and Reciprocity Effects on the Fade Rate of Inkjet Photographic Prints", Proceedings of IS&T's NIP16: International Conference on Digital Printing Technologies, Vancouver, BC, October 2000. It is believed that the poor image fastness may be attributed to the greater permeability of the porous IRL's to oxygen and/other airborne reactants such as ozone.

EP-A 1,034,940A1 discloses an ink jet-recording element wherein the image-receiving layer contains inorganic particles and an oil dispersion containing a hydrophobic antioxidant dispersed in a high-boiling organic solvent. However, there is a problem with this element in that the mechanical strength and surface scratch and rubbing resistance of the image-receiving layer are significantly reduced.

It is an object of this invention to provide a glossy ink jet recording element that, when printed with dye-based inks, provides good surface gloss, fast drying time, and excellent image fastness.

SUMMARY OF THE INVENTION

This and other objects are achieved in accordance with the invention which comprises an inkjet recording element comprising a support having thereon an image-receiving layer comprising inorganic particles and stabilizer particles, the stabilizer particles being free of any organic solvent and comprising greater than about 80% by weight of a water-insoluble antioxidant and having a mean particle size of greater than 5 nm, the inorganic particles comprising greater than about 50% by weight of the ink receiving layer.

By use of the invention, an inkjet recording element is obtained that, when printed with dye-based inks, provides good surface gloss, fast drying time, and excellent image fastness.

DETAILED DESCRIPTION OF THE INVENTION

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

In a preferred embodiment of the invention, the inkjet recording element of the invention contains a base layer between the support and the image-receiving layer. In another preferred embodiment, the base layer comprises inorganic particles and stabilizer particles, the stabilizer particles being free of any organic solvent and comprising greater than about 80% by weight of a water-insoluble antioxidant and having a mean particle size of greater than 5 nm, and the inorganic particles comprising greater than about 50% by weight of the base layer.

As noted above, the image-receiving layer and preferably the base layer contain at least about 50% by weight of inorganic particles. In a preferred embodiment, the inorganic particles comprise calcium carbonate, magnesium carbonate, kaolin, clay, talc, calcium sulfate, barium sulfate, titanium dioxide, zinc oxide, zinc hydroxide, zinc carbonate, aluminum silicate, calcium silicate, magnesium silicate, synthetic amorphous silica, fumed silica, colloidal silica, silica gel, alumina gel, fumed alumina, colloidal alumina, pseudo-boehmite, or zeolite. In another preferred embodiment, the inorganic particles have a mean particle size of from about 50 nm to about 500 nm.

Porosity of the image-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small so that they do not scatter visible light.

In still another preferred embodiment, the image-receiving layer and base layer contains a binder such as a polymeric material and/or a latex material, such as poly(vinyl alcohol) and/or styrene-butadiene latex. In still another preferred embodiment, the binder in the base layer is present in an amount of from about 5 to about 20 weight %. In still another preferred embodiment, the thickness of the base layer may range from about 5 μm to about 50 μm, preferably from about 20 to about 40 μm.

As noted above, the stabilizer particles useful in the invention comprise greater than about 80% by weight of a water-insoluble antioxidant and have a mean particle size of greater than 5 about nm. Examples of antioxidants which may be used in the invention include a substituted phenol, aromatic amine, piperidine-based amine, mercaptan, organic sulfide or organic phosphate. Preferred antioxidants include hindered phenols in which at least one of the hydroxyl groups in the ortho position is substituted with a tertiary alkyl group, or at least one hydroxyl group in the phenols or hydroxybenzene is modified to other by an alkyl group.

Specific examples of water-insoluble antioxidants useful in the invention include:

S-1

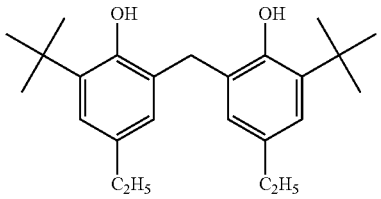

S-2

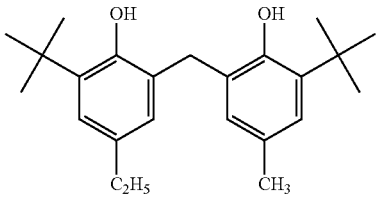

S-3

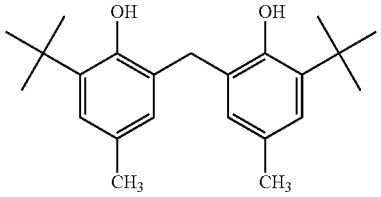

S-4

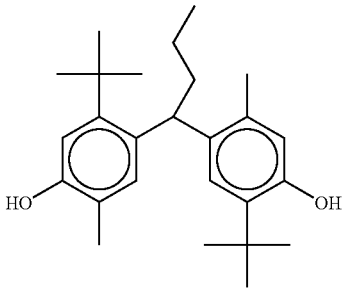

S-5

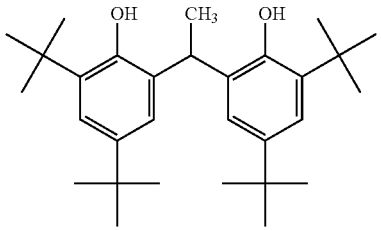

S-6

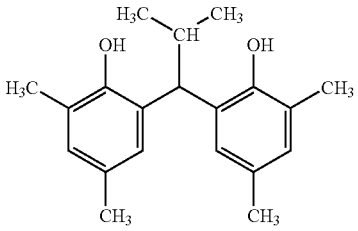

-continued
S-7
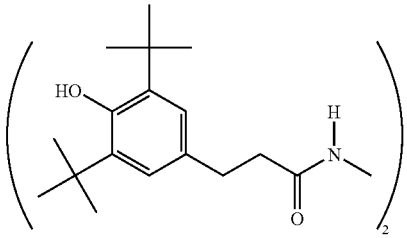
S-8
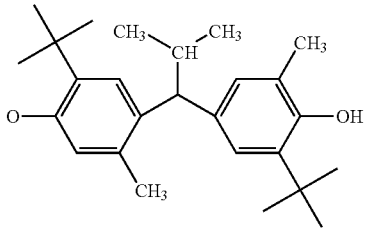
S-9
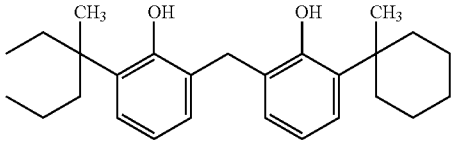
S-10
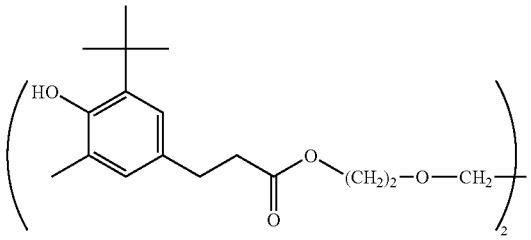
S-11
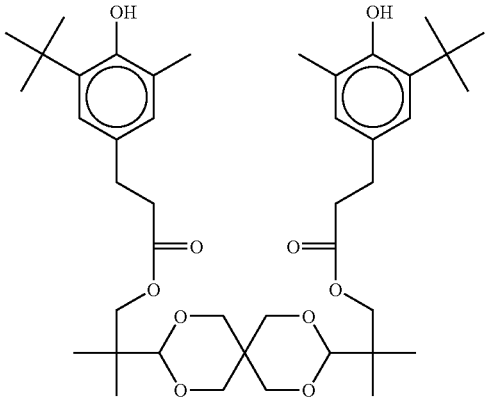
S-12
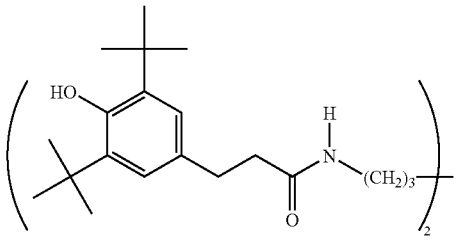
S-13
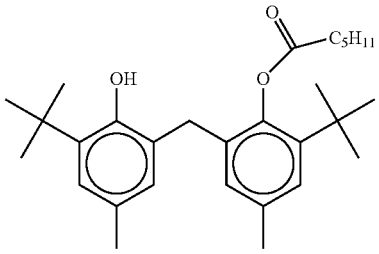
S-14
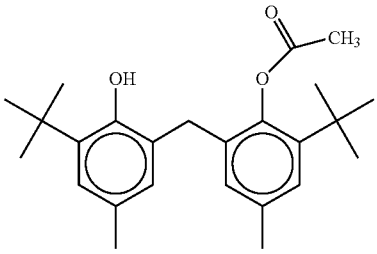
S-15
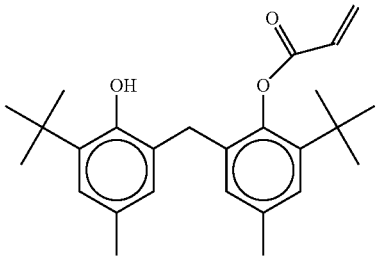
S-16
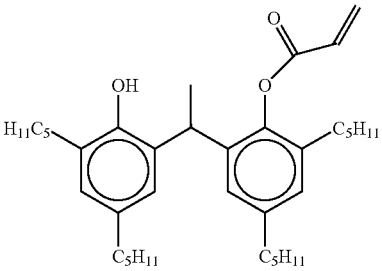
S-17
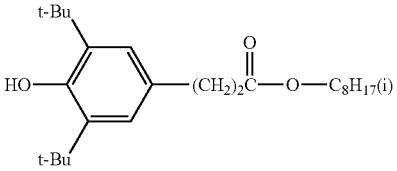
S-18
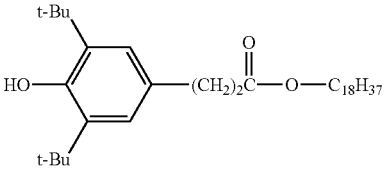

-continued
S-19
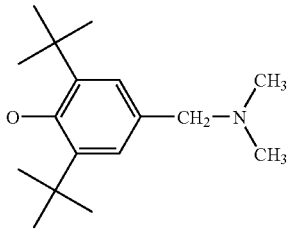
S-20
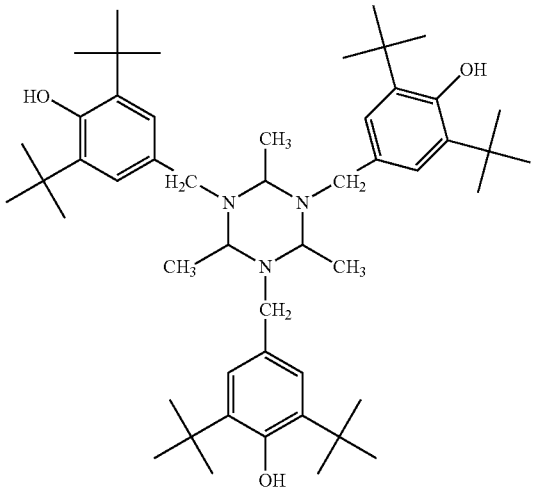
S-21
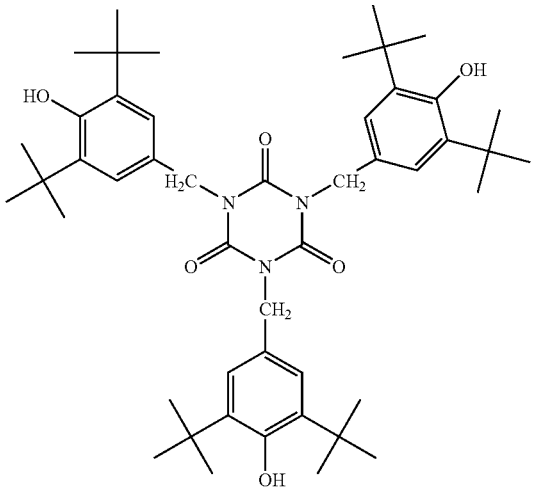
S-22
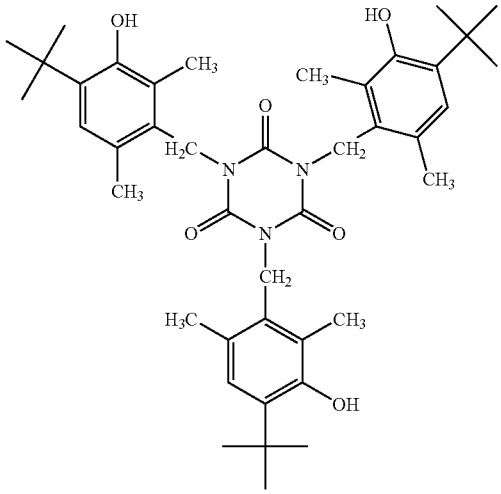
S-23
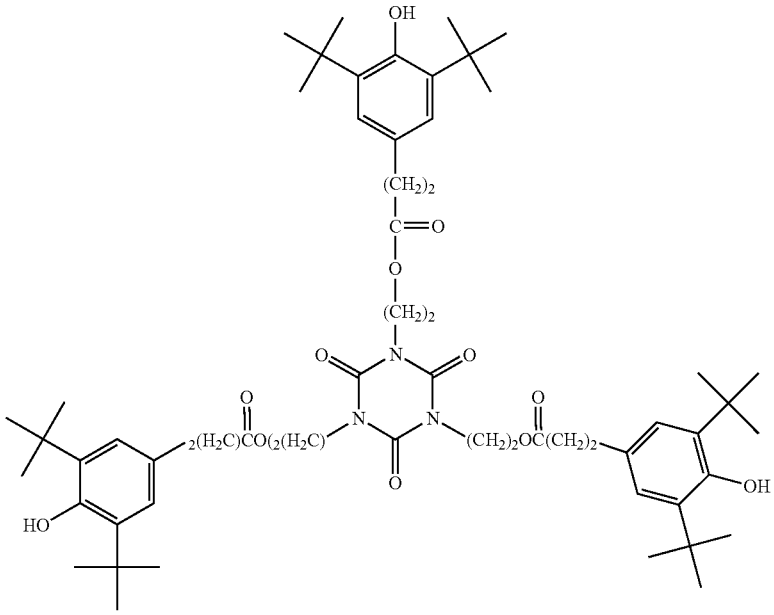

-continued
S-24
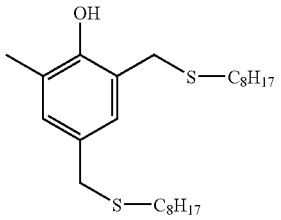
S-25
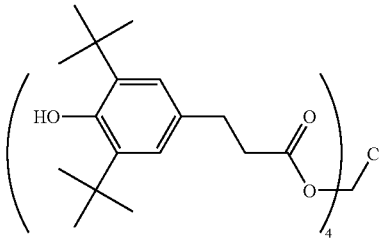
S-26
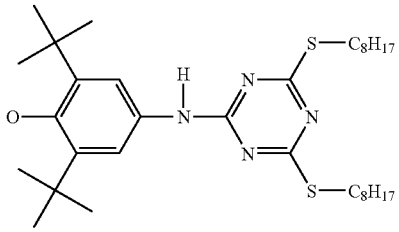
S-27
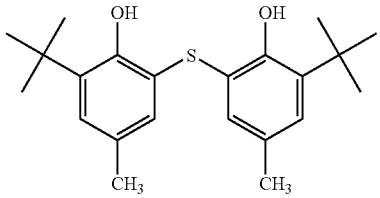
S-28
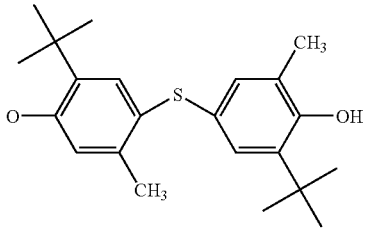
S-29
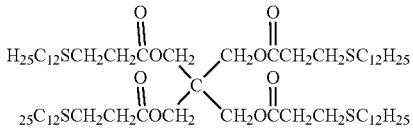
S-30
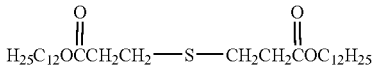
S-31
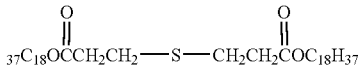
S-32
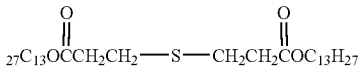
S-33
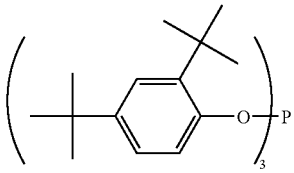
S-34
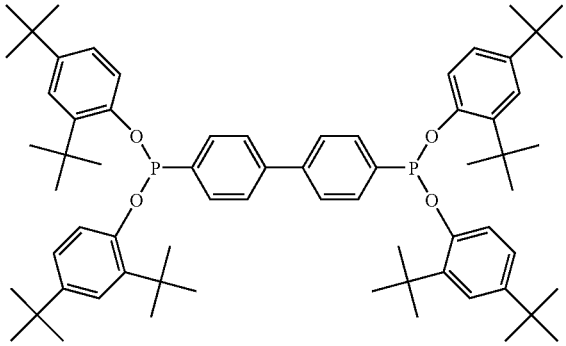
S-35
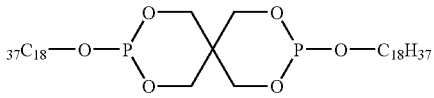
S-36
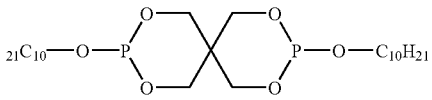
S-37
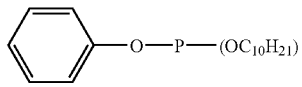
S-38
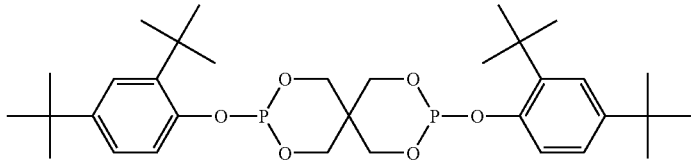

-continued

S-39

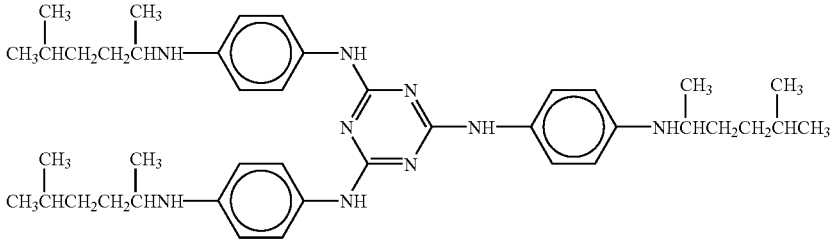

S-40

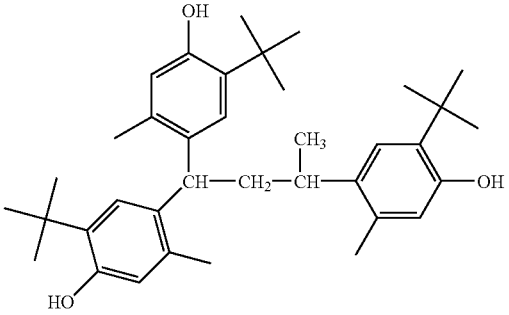

S-41

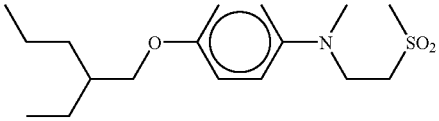

The stabilizer particles used in the present invention may contain a dispersant or surfactant. Depending on the intended applications, the dispersant can be nonionic, anionic, or cationic, and can be polymeric. The surfactants may be used at levels as high as 20% of the stabilizer particle.

Stabilizer particles employed in the invention can be formed by various methods known in the art. For example, they can be prepared by pulverizing and classifying the dry antioxidant or by spray drying of a solution containing antioxidant followed by re-dispersing the resultant particles in water using a dispersant. The particles can also be prepared by a suspension technique which consists of dissolving an antioxidant in, for example, a water immiscible solvent, dispersing the solution as fine liquid droplets in aqueous solution, and removing the solvent by evaporation or other suitable techniques. The particles can also be prepared by mechanically grinding an antioxidant material in water to a desired particle size in the presence a dispersant. The particles can also be prepared by the so-called "atmospheric emulsification" and "pressure emulsification" techniques. The atmospheric emulsification process is used to prepare antioxidant dispersions for antioxidants with melting points below the boiling point of water. The process typically consists of melting the antioxidant and a surfactant together, and optionally adding a base. Hot water is then slowly added to the antioxidant solution with vigorous agitation. The antioxidant dispersion can also be made by adding a molten antioxidant/surfactant blend to boiling water with vigorous agitation. The pressure emulsification technique is generally used with an antioxidant having a melting point greater than 100° C.

The stabilizer particles useful for the practice of the invention have a mean particle size of greater than about 5 nm, preferably, a mean size of from about 5 nm to about 10 μm. When used in the image receiving layer, the stabilizer particles preferably have a mean size of from about 5 nm to about 500 nm, and more preferably from about 5 nm to about 300 nm. In a preferred embodiment, the coating weight of the stabilizer particles in the ink receiving layer varies from about 10 mg/m$^2$ to about 5 g/m$^2$, and more preferably from 100 mg/m$^2$ to about 2 g/m$^2$.

In another preferred embodiment, the image-receiving layer contains a dye fixing agent. For fixing cationic dyes, the image-receiving layer preferably contains an anionic fixing agent. For fixing anionic dyes, the image receiving layer preferably contains a cationic fixing agent. Amphoteric fixing agent can also be used for fixing either cationic dyes or anionic dyes. Such fixing agents can be water soluble or insoluble. Preferably, the fixing agents are water-dispersible polymer particles.

The thickness of the image-receiving layer may range from about 5 to about 40 μm, preferably from about 10 to about 20 μm. The coating thickness required is determined through the need for the coating to act as a sump for absorption of ink solvent and the need to hold the ink near the coating surface.

After coating, the ink jet recording element may be subject to calendering or supercalendering to enhance surface smoothness. In a preferred embodiment of the invention, the inkjet recording element is subject to hot, soft-nip calendering at a temperature of about 65° C. and pressure of 14000 kg/m at a speed of from about 0.15 m/s to about 0.3 m/s.

Coating compositions employed in the invention may be applied by any number of well known techniques, including dip-coating, wound-wire rod coating, doctor blade coating, rod coating, air knife coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10-40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Preparation of Stabilizer Particle Dispersions

A stabilizer particle dispersion refers to a suspension of stabilizer particles in an aqueous medium.

SP-1:

In a container, solution A was prepared by combining 240 g of S-11 (illustrated above) with 360 g of ethyl acetate and heating to 50° C. with mixing to dissolve the antioxidant. In a separate container, solution B was prepared by combining 250 g of a 20% polyvinyl alcohol solution of Airvol 205® (Air Products Corp.), 140 g of Alkanol XC® anionic surfactant (DuPont Corp.), 4 g of a 0.7% Kathon LX® solution (Rohm and Haas) and 1006 g of deionized water and heating to 45° C. with mixing.

A premix (a crude oil-in-water emulsion) was formed by mixing solution A and solution B with a Silverson rotor-stator device at 5,000 rpm and mixing continued for two minutes. Then the premix was passed through a Crepaco high energy homogenizer one time at $1.4\times10^6$ kg/m$^2$ (2,000 psi) and the fine emulsion was collected in a glass round-bottom flask. The emulsion was rotary evaporated at 65° C. under vacuum to remove ethyl acetate and some water. The resulting fine particles of antioxidant in water were sized on a Microtrac—UPA 150 and found to have a mean volume average diameter of 220 nm.

SP-2:

SP-2 was prepared in a similar manner as SP-1 except stabilizer S-20 was used instead of S-11.

SP-3:

SP-3 was prepared in a similar manner as SP-1 except that cetyltrimethylammonium bromide (CTAB) was used instead of the Alkanol XC® surfactant

SP-4:

SP-4 was prepared in a similar manner as SP-2 except that CTAB was used instead of the Alkanol XC® surfactant.

SP-5:

SP-5 was prepared in a similar manner as SP-1 except that polyvinyl alcohol was not used.

SP-6:

SP-6 was prepared in a similar manner as SP-2 except that polyvinyl alcohol was not used.

SP-7:

SP-7 was prepared in a similar manner as SP-5 except that it contained a mixture of S-11 and S-41 at a ratio of 90:10 instead of S-11.

SP-8:

SP-8 was prepared in a similar manner as SP-3 except that contained a mixture of S-11 and S-41 at a ratio of 90:10 instead of S-11.

Preparation of Modified Colloidal Silica Particle Dispersion

To 325 g of Nalco 2329® solution (40% solids from Nalco Co.) was added at room temperature dropwise, 1.29 g of aminopropyl methyl dimethoxysilane under stirring. The reaction was allowed to continue at room temperature for 24 hours before use.

Preparation of Base Layer Coating Solution 1

A coating solution was prepared by mixing (1) 242.6 g of water
(2) 225.6 g of Albagloss-s® precipitated calcium carbonate (Specialty Minerals Inc.) at 70 wt. %
(3) 8.75 g of silica gel Crosfield 23F® (Crosfield Ltd.)
(4) 8.75 g of Airvol 125® poly(vinyl alcohol) (Air Product) at 10 wt. %
(5) 14.3 g of styrene-butadiene latex CP692NA® (Dow Chemicals Corp.) at 50 wt. %
(6) 75 g of SP-1

Preparation of Base Layer Coating Solution 2

Base Layer 2 was prepared in a similar manner as Base Layer 1 except that it was prepared with SP-2 instead of SP-1

Preparation of Base Layer Coating Solution 3

Base Layer 3 was prepared in a similar manner as Base Layer 1 except it was prepared with SP-8 instead of SP-1.

Preparation of Base Layer Coating Solution 4

Base Layer 3 was prepared in a similar manner as Base Layer 1 except it was prepared without stabilizer particles.

Preparation of Image Receiving Layer Coating Solution 1

Image Receiving Layer Coating Solution 1 was prepared by combining alumina (Dispal 14N4-80®, Condea Vista Co.), fumed alumina (Cab-O-Sperse® PG003, Cabot Corp.), poly(vinyl alcohol) (Gohsenol® GH-17, Nippon Gohsei Co.) and P-2 in a ratio of 66:20:4:10 to give an aqueous coating formulation of 15% solids by weight. Surfactants Zonyl® FSN (DuPont Co.) and Silwet L-7602® (Witco Corp.) were added in small amounts as coating aids.

Preparation of Image Receiving Layer Coating Solution 2:

Image Receiving Coating Solution 2 was prepared by combing 269 g of the above modified Nalco 2329®, 82 g of P-1, and 1.12 g of surfactant Zonyl® FSN, and 44 g of a core/shell particle [silica core and poly(butyl acrylate) shell] as prepared by the procedure as described in the Example 1 of U.S. patent application Ser. No. 09/535,703, filed Mar. 27, 2000.

Preparation of Image Receiving Layer Coating Solution 3:

Image Receiving Coating Solution 3 was prepared the same as in Image receiving coating solution 2 except that the coating solution contained 90 g of SP-3.

Preparation of Image Receiving Layer Coating Solution 4:

Image receiving coating solution 4 was prepared the same as in Image receiving coating solution 2 except that the coating solution contained 90 g of SP-4.

Example 1

Stabilizer Particles in Base Layer

Comparative Element C-1 (No Stabilizer Particles in the Base Layer)

Base layer coating solution 4 was coated onto a photographic base paper and dried at about 90° C. to give a dry thickness of about 25 μm or a dry coating weight of about 27 g/m$^2$.

Image receiving layer coating solution 1 was coated on the top of the base layer and dried at 90° C. to give a dry thickness of about 8 μm or a dry coating weight of about 8.6 g/m$^2$.

Element 1 (Invention)

Element 1 was prepared the same as Comparative Element 1 except that the base layer coating solution 3 was used.

Element 2 (Invention)

Element 3 was prepared the same as Comparative Element 1 except that the base layer coating solution 1 was used.

Printing and Ambient Light Fading Test

The above elements were printed using a Kodak PPM 200® printer using color cartridges number 195-1730. The image consisted of adjacent patches of cyan, magenta, yellow, black, green, red and blue patches, each patch being in the form of a rectangle 0.4 cm in width and 1.0 cm in length. The images were then subjected to an ambient fluorescence white light fading test for up to one week. The reflection density nearest to 1.0 was compared before and after fade and a percent density loss was calculated for the yellow dye with each receiver element. The following results were obtained:

TABLE 1

| Element | Magenta Density Loss (%) | Black Density Loss (%) |
|---|---|---|
| C-1 | 20 | 18 |
| 1 | 11 | 8 |
| 2 | 11 | 7 |

The above results show that the elements prepared in accordance with the invention had less dye loss as compared to the comparative element.

Example 2

Stabilizer Particles in Image-Receiving Layer

Comparative Element C-2 (No Stabilizer Particles in Image-Receiving Layer)

Element C-2 was prepared the same as Element C-1 except that the imaging receiving layer coating solution 2 was used.

Element 3 (Invention)

Element 3 was prepared the same as Element 1 except that the image receiving layer coating solution 3 was used.

Element 4 (Invention)

Element 4 was prepared the same as Element 1 except that the image receiving layer coating solution 4 was used.

Gloss

The above recording elements were measured for 60° specular gloss using a Gardener® Gloss Meter.

The above elements were then printed and tested as in Example 1. The following results were obtained:

TABLE 2

| Element | Gloss[1] | Gloss[2] | Magenta Density Loss (%)[1] | Magenta Density Loss (%)[2] |
|---|---|---|---|---|
| C-2 | 30 | 52 | 64.6 | 58.1 |
| 3 | 41 | 61 | 17.2 | 25.3 |
| 4 | 38 | 62 | 14 | 22.4 |

[1]Before calendering

[2]After calendering at 0.42 × 10$^6$ kg/m$^2$ (600 psi) and 52° C.

The above results show that the elements of the invention had less magenta density loss before and after calendering as compared to the comparative element.

Accelerated Ozone Test:

The above printed elements were then exposed to ambient ozone for up to two weeks. The reflection density nearest to 1.0 was compared before and after exposure to ozone (50 ppb concentration) for 3 and 5 days, respectively, and a percent density loss was calculated for the yellow dye with each receiver element. The following results were obtained:

TABLE 3

| | Magenta Density Loss (%) | | Cyan Density Loss (%) | |
|---|---|---|---|---|
| Element | 3 days | 5 days | 3 days | 5 days |
| C-2 | 42 | 62 | 6 | 13 |
| 3 | 25 | 36 | 3 | 4 |
| 4 | 23 | 37 | 3 | 5 |

The above results show that the elements of the invention had less magenta and cyan density loss when exposed to ozone as compared to the comparative element.

Example 3

Stabilizer Particles in Base Layer and Image-Receiving Layer

Element 5 (Invention)

Element 5 was prepared the same as Element 3 except that the base layer coating solution 1 was used.

Element 6 (Invention)

Element 6 was prepared the same as Element 4 except that the base coating solution 2 was used.

The above elements were subjected to the accelerated ozone test as in Example 2. The following results were obtained:

TABLE 4

| | Magenta Density Loss (%) | | Cyan Density Loss (%) | |
|---|---|---|---|---|
| Element | 5 days | 7 days | 5 days | 7 days |
| 5 | 15 | 36 | 2 | 8 |
| 6 | 12 | 23 | 2 | 5 |

The above results show that the elements of the invention had good resistance to ozone fade.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon an image-receiving layer having a thickness of 5 to 20 microns and, between said support and said image-receiving layer, a base layer having a thickness of 20 to 50 microns, both layers comprising inorganic particles and stabilizer particles in an amount of from about 10 mg/m$^2$ to about 5 g/m$^2$, said stabilizer particles being free of any organic solvent and comprising greater than about 80% by weight of a water-insoluble antioxidant and having a mean particle size of greater than about 5 nm to 500 nm, said inorganic particles comprising greater than about 50% by weight of said image-receiving layer and of said base layer, wherein greater than 50% by weight of said base layer comprises inorganic particles consisting of precipitated calcium carbonate and silica gel, and wherein the base layer also contains binder in the amount of from about 5 to about 20 weight percent, and wherein greater than 50% by weight of the image-receiving layer consist of inorganic particles selected from the group consisting of fumed silica, colloidal silica, fumed alumina, colloidal alumina, and pseudo-boehmite and wherein the inorganic particles in the image-receiving layer have a mean particle size of 50 nm to 500 nm, wherein the coating thickness of the image-receiving layer is determined such that the image-receiving layer holds ink near the surface of the image-receiving layer, above the base layer, when ink in a solvent is applied to the ink jet recording element by an ink jet printer and wherein the image-receiving layer has no UV absorbers for preventing light fade.

2. The recording element of claim 1 wherein said image-receiving layer also contains a binder in an amount of from about 5 to about 20 weight %.

3. The recording element of claim 2 wherein said binder is a hydrophilic polymer.

4. The recording element of claim 2 wherein said binder is a core/shell latex.

5. The recording element of claim 1 wherein said antioxidant comprises a substituted phenol, aromatic amine, piperidine-based amine, mercaptan, organic sulfide or organic phosphate.

6. The recording element of claim 1 wherein said stabilizer particle also contains a dispersant or surfactant.

7. The recording element of claim 6 wherein said dispersant or surfactant is present in said stabilizer particle up to about 20% by weight.

* * * * *